United States Patent [19]

Werner

[11] Patent Number: 4,653,200

[45] Date of Patent: Mar. 31, 1987

[54] LINT SCREEN SHIELD ASSEMBLY FOR A DRYER

[75] Inventor: Kurt Werner, St. Joseph Township, Berrien County, Mich.

[73] Assignee: Whirlpool Corporation, Benton Harbor, Mich.

[21] Appl. No.: 836,297

[22] Filed: Mar. 5, 1986

[51] Int. Cl.[4] ..... F26B 21/06

[52] U.S. Cl. ..... 34/82; 34/133; 55/359; 55/493

[58] Field of Search ..... 34/82, 133; 55/493, 55/359

[56] References Cited

U.S. PATENT DOCUMENTS 2,550,118 4/1951 Kauffman, II .
2,612,705 10/1952 Kauffman, II .
3,889,392 6/1975 Davis et al. ..... 34/82

FOREIGN PATENT DOCUMENTS 1554725 10/1979 United Kingdom .

*Primary Examiner*—Larry I. Schwartz

[57] ABSTRACT

A lint filter for use in a clothes dryer includes a lint shield extending thereover with a door slidable over a through opening and a catch on the door to open the door as the filter is inserted into the dryer and to close the door as the filter is withdrawn. The lint shield covers the filter to prevent lint from accidentally falling therefrom and is hingedly connected to the filter for access during cleaning.

10 Claims, 6 Drawing Figures

14
46
56
50
40
58
44
52
64
66
68
70
74
76
IV
V
53
60
62
65
42
28
72
24

LINT SCREEN SHIELD ASSEMBLY FOR A DRYER

BACKGROUND OF THE INVENTION

1. Field of the Invention

The present invention relates generally to an openable shield for a removable dryer lint screen.

2. Description of the Prior Art

U.S. Pat. No. 2,612,705 discloses a dryer having a removable lint trap. The lint trap has a cover held in place by a spring which is openable to permit screens within the trap to be cleaned.

U.S. Pat. No. 2,550,118 discloses a dryer having a filter screen which is slidable to one side to permit access to a duct for removing lint.

British Pat. No. 1,554,725 discloses a washer-dryer having a lint screen that is carried by a removable drawer. The screen forms a rear wall of the drawer and air flow through the drawer is such that lint collects on the screen surface within the drawer.

U.S. Pat. No. 3,889,392 discloses a removable dryer lint screen that is withdrawn through a top panel of an automatic clothes dryer.

SUMMARY OF THE INVENTION

The present invention prevents lint that has been collected on a dryer lint screen from falling therefrom, and especially from falling onto freshly laundered clothes as the lint screen is removed from the dryer. The invention is embodied in a lint screen shield assembly attached to a removable dryer lint screen. The shield assembly has a closable opening through which lint laden air passes for filtering and which is closed as the lint screen is withdrawn from a clothes dryer. The shield assembly, in one embodiment, is hingedly openable for access to the lint screen to clean the lint therefrom. As the lint screen and shield assembly are reinserted into the dryer, the closable opening is opened so that the screen can filter lint particles from the dryer exhaust air.

In one embodiment, the opening is closable by a sliding door having a clip that engages a pin mounted within the dryer to move the sliding door to an open position when the filter screen and shield are within the dryer and to close the sliding door as the shield and screen assembly is removed.

The present invention is particularly well adapted for use with lint screens which are removable through the top panel of a clothes dryer with the lint accumulating surface facing downwardly. Lint is prevented from falling onto the dryer or the clothes load during removal of the lint screen even if such removal causes flexing of the screen.

DESCRIPTION OF THE PREFERRED EMBODIMENTS

Figure 1:
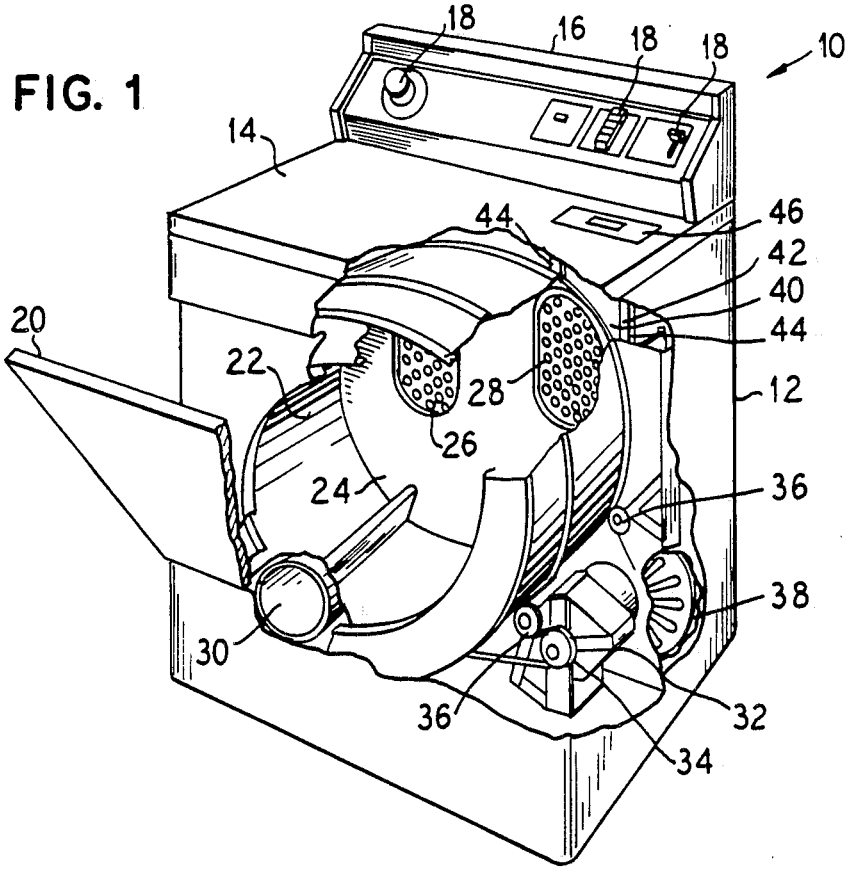
FIG. 1 is a perspective view of a clothes dryer including a lint screen shield according to the principles of the present invention.

In FIG. 1, there is shown generally an automatic clothes dryer at 10 including an exterior cabinet 12 with the top panel 14 having a control console 16 along the rear portion thereof incorporating a plurality of controls 18 for selecting an automatic series of drying steps. The dryer cabinet 12 has a front openable door 20 providing access to the interior of a rotatable dryer drum 22 which rotates about a horizontal axis and has a non-rotating rear bulkhead 24 with air inlets 26 and air outlets 28 therein for charging the interior of the drum 22 with heated air from a heater 30 and for exhausting moisture laden air. An electric motor 32 is provided to rotate the drum 22 through a pulley arrangement 34, the drum rotating on a plurality of rollers 36. The motor 32 also drives a fan 38 which provides the air flow through the interior of the drum. Downstream of the air outlet 28 is a lint screen 40 and a lint shield 42 held within an exhaust chute 44. A handle 46 affixed to the lint screen 40 extends through the top panel 14.

Figure 2:
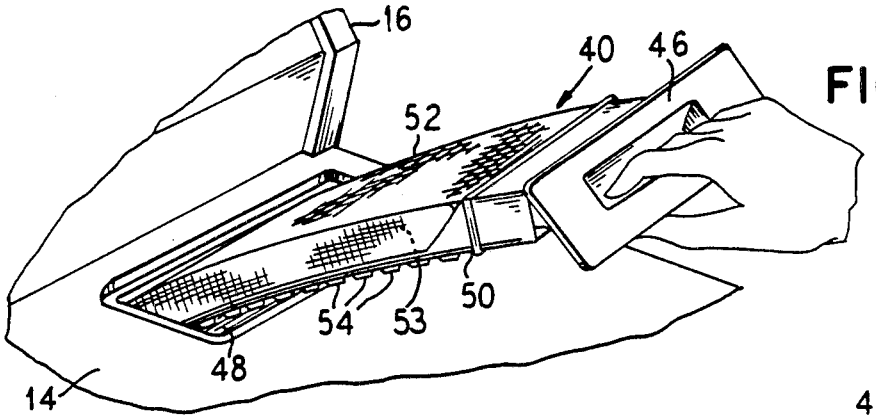
FIG. 2 is a fragmentary view showing a lint screen and lint shield assembly being removed from the dryer of FIG. 1.

In FIG. 2, the lint screen 40 and lint shield 42 are shown being removed through an aperture 48 in the top dryer panel 14. The lint screen 40 includes a frame 50 on which is mounted a screen web 52 for collecting lint. The screen web 52 has a first surface 53 on which lint is accumulated during dryer operation. As can be seen the lint accumulating surface 53 faces downwardly when the screen 40 is removed, resulting in the possibility that lint will fall onto the top panel 14 and onto laundered clothes resting thereon or on the door 20 if the lint shield 42 were not in place. The frame 50 is flexible to bend when inserted into and removed from the lint chute 42. A row of rectangular projections 54 are provided on each side of the frame 50 to add rigidity to the frame; spacings between the projections 54 permit bending of the frame 50 and screen as required. Bending of the lint screen 40 as it is removed further increases the tendency of the lint to fall off the screen 40, where it is caught by the shield 42.

Figures 3, 4, 6:
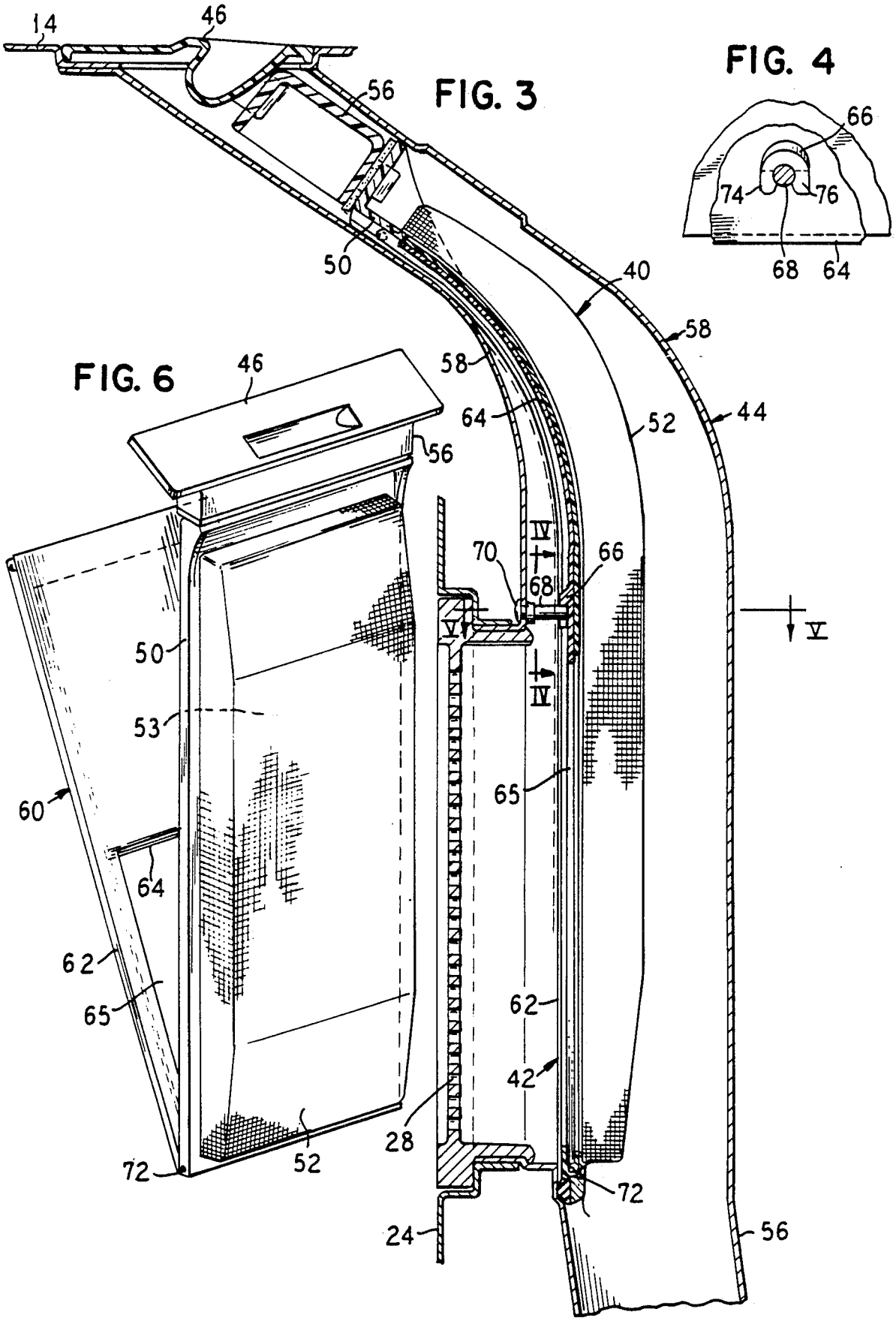
FIG. 3 is a lateral cross-section of the lint screen chute of the dryer shown in FIG. 1 showing the lint screen and shield assembly within a dryer.
FIG. 4 is a fragmentary cross-section of a catch on the lint shield assembly taken through lines IV—IV of FIG. 3.
FIG. 6 is a perspective view of the lint screen and shield assembly removed from the dryer and open for cleaning.

In FIG. 3, the screen 40 is shown disposed within the chute 44 with the handle 46 flush with the top panel 14 and the screen web 52 spanning the air outlets 28. A spacer 56 connects the handle 46 to the frame 50. The chute 44 is curved at 58 to enable the screen web 52 to lie behind the drum 22, yet ensure that the handle 46 is within easy reach before the control console 16. The curve 58 causes flexing of the lint screen 40 as it is moved along the chute 44.

The lint shield 42 is mounted extending along the length of the filter web 52 at its upstream side and includes a frame 62 with a slidably mounted door 64 over an opening 65. The door 64 includes a latch, or catch, 66 which engages a probe 68 extending from the chute wall at 70. The lint shield 42 is hingedly attached to the filter 40 along a bottom edge thereof by a hinge 72. The lint shield 42 is formed of flexible material to lie flush with the filter 40 and to bend as the filter 40 and shield 42 are moved along the chute 44. In a preferred embodiment, the filter frame 50 and lint shield 42 are each formed of polypropylene.

In FIG. 4, the latch 66 is shown engaging the probe 68. In one embodiment, the latch 66 includes spaced legs 74 and 76 which are spaced slightly less at the free ends thereof than the diameter of the probe 68 so that the latch 66 snaps into engagement with opposite sides of the probe 68 by a resilient, snap-fit action. The latch 66 engages the probe 68 as the filter 40 and shield 42 are moved into the chute 44 causing the door 64 to move to its open position. The latch 66 remains engaged to the probe 68 as the filter 40 and shield 42 are withdrawn until the door 64 is in the closed position, at which time the latch 66 disengages.

Figure 5:
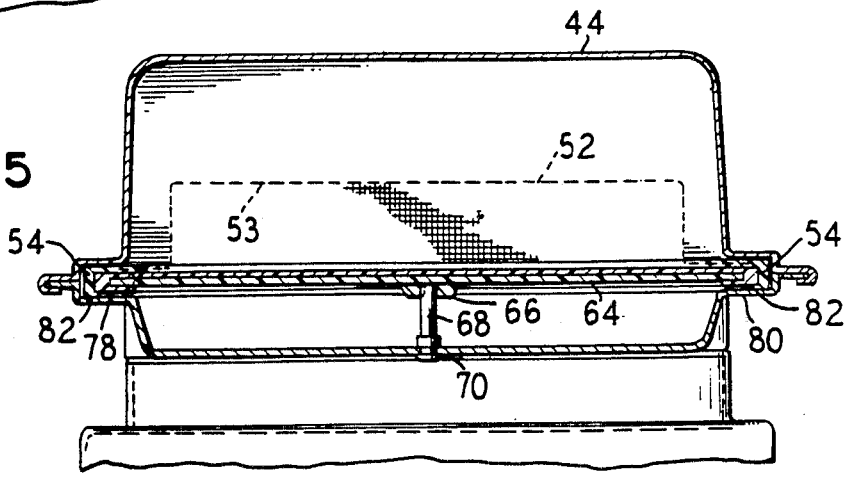
FIG. 5 is a cross-section through lines V—V of FIG. 3 showing the lint screen and shield assembly within the chute.

In FIG. 5, the lint shield 42 extends across the entirety of the filter web 52 and to the projections 54. The frame 62 of the lint shield 42 is held, in one embodiment, against the filter 40 by small projections 82 extending inwardly at the ends of the projections 54 to engage opposite edges of the frame 62. The door 64 is slidably mounted within rails 78 and 80 to open and close the opening 64 as the probe 68 engages the latch 66.

In FIG. 6, the lint shield 42 is shown hingedly moved away from the filter 40 to provide access to the lint accumulating surface 53 of the filter web 52 for cleaning. the door 64 is shown in its open position, although ordinarily withdrawal of the filter 40 and lint shield 42 from the chute 44 causes the door 64 to close. The lint shield 42 completely blocks access to the lint accumulating surface 53 when the lint door 64 is closed and the shield 42 is against the filter 40, yet enables the filter 40 to function virtually uninhibited when the door 64 is open within the chute 44.

The present lint shield 42 operates as follows: when the filter 40 and lint shield 42 are slid into the chute 44, the probe 68 abuts the latch 66 to slide the door 64 to its open position. Just as the filter 40 reaches its fully inserted position, the top of the door 64 abuts the top of the door track 78 to cause the latch 66 to snap over the probe 68.

After one or more dryer loads have been run in the dryer 10 and lint has accumulated on the filter web 52, the filter 40 is removed from the chute 44 for cleaning. As the filter 40 with the lint shield 42 attached is withdrawn from the chute 44, the latch 66 grips the probe 68 to cause the door 64 to slide to its closed position. Once the door 64 is fully closed, it abuts the bottom of the door track 78 and the latch 66 disengages from the probe 68. Thus, upon removal of the filter 40, the lint shield door 64 is closed so that any lint that falls from the filter web 52 is caught by the shield 42. The lint shield 42 can then be hingedly moved away from the filter 40 in a convenient location, such as over a waste container, for cleaning of the filter web 52.

The present shield 42 does not inhibit the operation of the filter 40 since the filter web 52 is generally substantially larger than the air outlet 28. Also, the lint laden air can flow between the shield 42 and the web 52 to reach the portions of the web 52 not directly behind the outlet 28.

Although a snap-fit latch has been shown and described, it is within the spirit of the present invention to utilize other types of latches or catches to move the door 64 between its open and closed position. For instance, a magnetic catch or a spring biased cabinet-type catch may be used. It is also foreseen to use a multi-segmented door having a plurality of leaves so that the opening provided through the lint shield may be larger. A roll-up type door may also be provided. Furthermore, alternate means for latching the lint shield to the filter assembly may be provided, such as a snap-type catch or a slotted opening at the handle or a portion of the lint shield extending upwardly to form an integral part of the handle. Although shown with a lint screen removable through the top of a dryer, the present invention could be practiced on any type of dryer having a removable lint filter.

Thus, there has been shown and described a lint filter shield for use in a clothes dryer to prevent lint from falling off of a lint filter screen. A door is provided in the lint shield 60 which automatically closes as the filter assembly is removed from the dryer and which automatically opens as the filter assembly is inserted into the dryer. The present invention captures lint falling from a lint screen, and thus prevents the lint from being deposited on top of the dryer or on the clothes load placed thereon.

As is apparent from the foregoing specification, the invention is susceptible to being embodied with various alterations and modifications which may differ particularly from those that have been described in the preceding specification and description. It should be understood that I wish to embody within the scope of the patent granted hereon all such modifications as reasonably and properly come within the scope of my contribution to the art.

The embodiments of the invention in which an exclusive property or privilege is claimed are defined as follows:

1. A lint shield for use on a removable lint filter for use in a dryer and having a filter element mountable in a gas stream to accumulate lint on a first side thereof, comprising:

a frame at least as large as the filter element and defining a through opening through which the gas stream flows to the filter element;

a door slidably mounted in said frame for selectively closing said through opening;

means for selectively securing said frame to the lint filter over the lint accumulating side of the filter element; and means for moving said door to an open position when the lint filter and said lint shield are mounted in the dryer and for moving said door to a closed position when the lint filter and said lint shield are removed from the dryer.

2. A lint filter for use in a clothes dryer having an exhaust means for generating an air flow of lint laden air and a lint screen chute for holding a lint accumulating screen in the lint laden air flow, comprising:

a lint filter assembly having a filter frame and a filter web mounted on said frame, said filter assembly being insertable into the lint screen chute in the lint laden air flow;

a lint shield securable to said filter assembly at an upstream side and defining an opening through which the air flow passes;

means for closing said through opening when said lint shield is withdrawn from the chute; and means for opening said through opening when said lint shield is inserted into the chute;

whereby said lint shield prevents lint from falling from said lint filter assembly upon removal from the dryer.

3. A lint filter as claimed in claim 2, wherein said closing means and said opening means includes:

at least one slidable door mounted to said lint shield over said through opening;

a catch on said slidable door; and a catch engaging means secured on an inside of the chute to engage said catch as said lint shield is moved along the chute.

4. A lint filter as claimed in claim 2, wherein said catch is a snap-fit catch and includes a pair of spaced legs, and said catch engaging means is a probe for selective engagement between said spaced legs.

5. A clothes dryer, comprising:

a rotatable drum in which clothes are tumbled during drying;

means for causing an air flow through said drum during tumbling whereby said air flow entrains lint particles upon passing through said drum;

an air exhaust outlet for exhausting said air flow from said dryer;

a filter receiving chute extending into said exhaust outlet and having a user accessible aperture;

a lint filter assembly for insertion into said chute through said aperture for accumulating lint entrained in said air flow on a first side of said lint filter assembly;

a lint shield hingedly affixed to said lint filter for placement adjacent said first lint filter side, said lint shield including a frame defining a through opening and having a track at least on opposed sides of said through opening;

a door slidably mounted in said lint shield track and being slidable over said through opening;

retaining means for selectively holding said lint shield adjacent said filter assembly; and catch means between said door and said filter receiving chute for opening said door as said lint shield is inserted into said chute and for closing said door as said lint shield is withdrawn from said chute.

6. A dryer as claimed in claim 5, wherein said catch means includes a snap-fit catch.

7. A dryer as claimed in claim 5, wherein said catch means includes a spring biased catch.

8. A dryer as claimed in claim 5, wherein said catch means includes a magnetic catch.

9. A dryer as claimed in claim 5, wherein said filter receiving chute is curved.

10. A dryer as claimed in claim 5, wherein said user accessible aperture is in a top panel of said clothes dryer.

* * * * *